US005441353A

United States Patent [19]

Kim

[11] Patent Number: 5,441,353

[45] Date of Patent: Aug. 15, 1995

[54] BORDERLESS PRINTER HAVING A ROTATING DRUM WITH CLAMP ASSEMBLY

[75] Inventor: Wan-ha Kim, Suwon-city, Rep. of Korea

[73] Assignee: Samsung Electronics Co., Ltd., Kyungki-Do, Rep. of Korea

[21] Appl. No.: 313,799

[22] Filed: Sep. 28, 1994

[30] Foreign Application Priority Data

Sep. 29, 1993 [KR] Rep. of Korea ..... 93-20555

[51] Int. Cl.[6] ..... B41J 13/02

[52] U.S. Cl. ..... 400/636.1; 400/578; 400/638; 400/639.1; 400/645.3; 346/138; 271/275

[58] Field of Search ..... 400/636, 636.1, 636.2, 400/636.3, 645, 617, 649, 638, 639.1, 639.2, 645.3, 645.4, 641, 578, 568, 548, 600.2; 346/134, 138; 271/275, 277

[56] References Cited

U.S. PATENT DOCUMENTS 4,500,219 2/1985 Lange et al. ..... 400/568
5,268,707 12/1993 Katsuma et al. ..... 346/138

FOREIGN PATENT DOCUMENTS 0067182 4/1985 Japan ..... 400/639.1
0013371 1/1987 Japan ..... 400/636.1

*Primary Examiner*—Chris A. Bennett
*Attorney, Agent, or Firm*—Sughrue, Mion, Zinn, Macpeak & Seas

[57] ABSTRACT

A borderless printer includes a clamp assembly having a clamp; at least one roller installed on the clamp and located on the circumferential surface of a drum and rotating while in contact with the drum; and a clutch placed between the clamp and drum, for permitting the drum to rotate relative to the clamp in one condition and for permitting the drum and clamp to rotate together in another condition, thereby simplifying the structure and preventing the waste of paper.

4 Claims, 6 Drawing Sheets

BORDERLESS PRINTER HAVING A ROTATING DRUM WITH CLAMP ASSEMBLY

BACKGROUND OF THE INVENTION

1. Field of the Invention

The present invention relates to a printer and, more particularly, to a borderless printer which prints an image on a sheet of paper without leaving top and bottom margins thereon.

2. Description of the Related Art

There are a variety of printers which print image data on a sheet of paper. One such printer is a thermal transfer printer which uses a thermal transfer head for transferring image data with heat and an ink film located under the thermal transfer head so as to print an image on a sheet of paper placed under the ink film. Especially, for full color printing, a color thermal transfer printer is constructed to superposingly print three colors of yellow, magenta and cyan of a color-separated image. The image obtained by such a printer is as sharp as a snapshot produced using an ordinary camera, which is developed on a sheet of photographic paper.

The thermal transfer printer can be put into practical use in a variety of fields. For instance, it can be used to output an image from an image input apparatus such as a scanner, to realize a computer graphic image, or to output an image of an electron microscope taken by a video camera.

FIGS. 1A and 1B illustrate sheets of paper bearing an image printed by a conventional printer. In practice, the image might be printed on a sheet of paper leaving top/bottom margins 2 thereon as shown in FIG. 1A, or might be skewed as shown in FIG. 1B.

The cause for these problems, i.e., the paper margins remaining or the printed image being skewed on the paper sheet, can be explained as follows. For instance, in a drum-type printer as shown in FIG. 2, a clamp 9 is used to force a paper sheet 13 into contact with a drum 16, such that printing is not performed on the leading edge of the paper sheet 13 which is in contact with the drum 16 by the clamp 9.

The above structure, which is mechanically constructed such that the paper sheet 13 is in contact with drum 16 by the action of the clamp 9, is overly complicated so that malfunctioning is common, whereby skewed images are printed as in FIG. 1B. At the very least, the above structure leaves border margins on the paper sheet, which degrade the overall appearance of the printed image. In the worst case, the printing must be performed again and accordingly wastes paper sheets. Further, an image inputted from a scanner must be reduced or truncated before printing.

SUMMARY OF THE INVENTION

Therefore, it is an object of the present invention to provide a printer which leaves no margins on a sheet of paper and prevents an image from being printed in a skewed state, resulting in a reduction in the wasting of paper sheets without a reduction or loss of the image to be printed and resulting in an image printed so as to have a photograph-like appearance, and which simplifies and accurately performs the operation of a clamp, thereby preventing false operation and reducing the production cost.

To accomplish the object of the present invention, there is provided a borderless printer comprising a rotating drum for conveying a sheet of paper, a clamp assembly rotatable with the drum for forcing the paper sheet into contact with the drum, and a printing head for printing an image on the paper sheet, the clamp assembly comprising: a clamp; at least one roller installed on the clamp and located at the circumferential surface of the drum and rotating while in contact with the drum; and clutch means placed between the clamp and drum, for permitting the drum to rotate relative to the clamp in one condition and for permitting the drum and clamp to rotate together in another condition.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE PREFERRED EMBODIMENT

Hereinafter, a preferred embodiment of the present invention will be described with reference to the attached drawings.

Figure 1A:
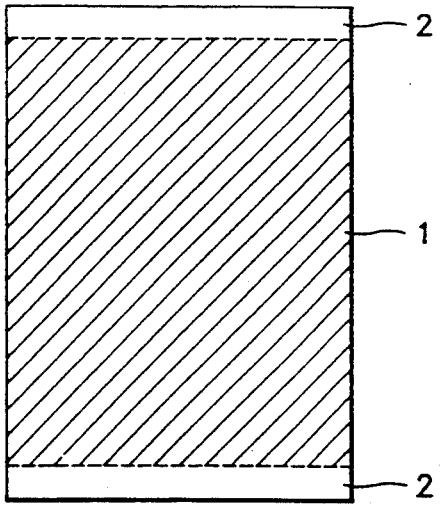
FIG.1A(PRIOR ART)
FIGS. 1A and 1B illustrate sheets of paper bearing images printed by a conventional printer.
Figure 1B:
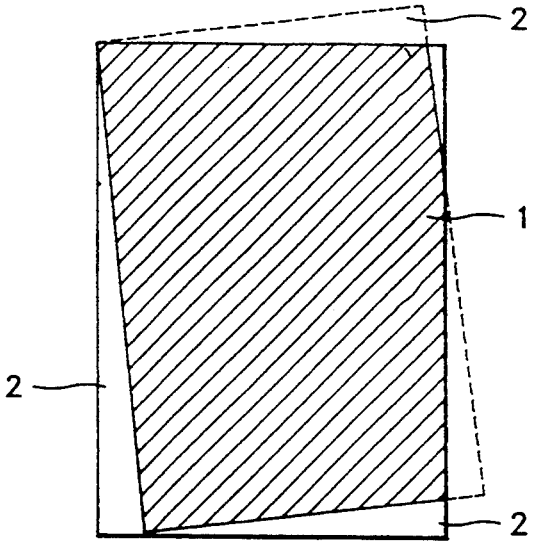
FIG.1B(PRIOR ART)
Figure 2:
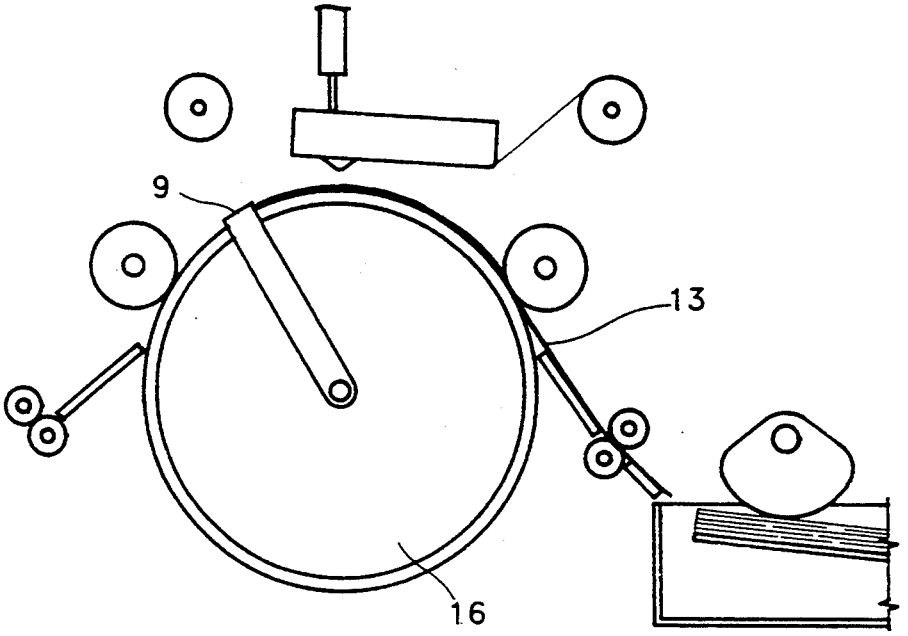
FIG.2(PRIOR ART)
FIG. 2 is a side view of a printing operation by a conventional drum-type printer.
Figure 3:
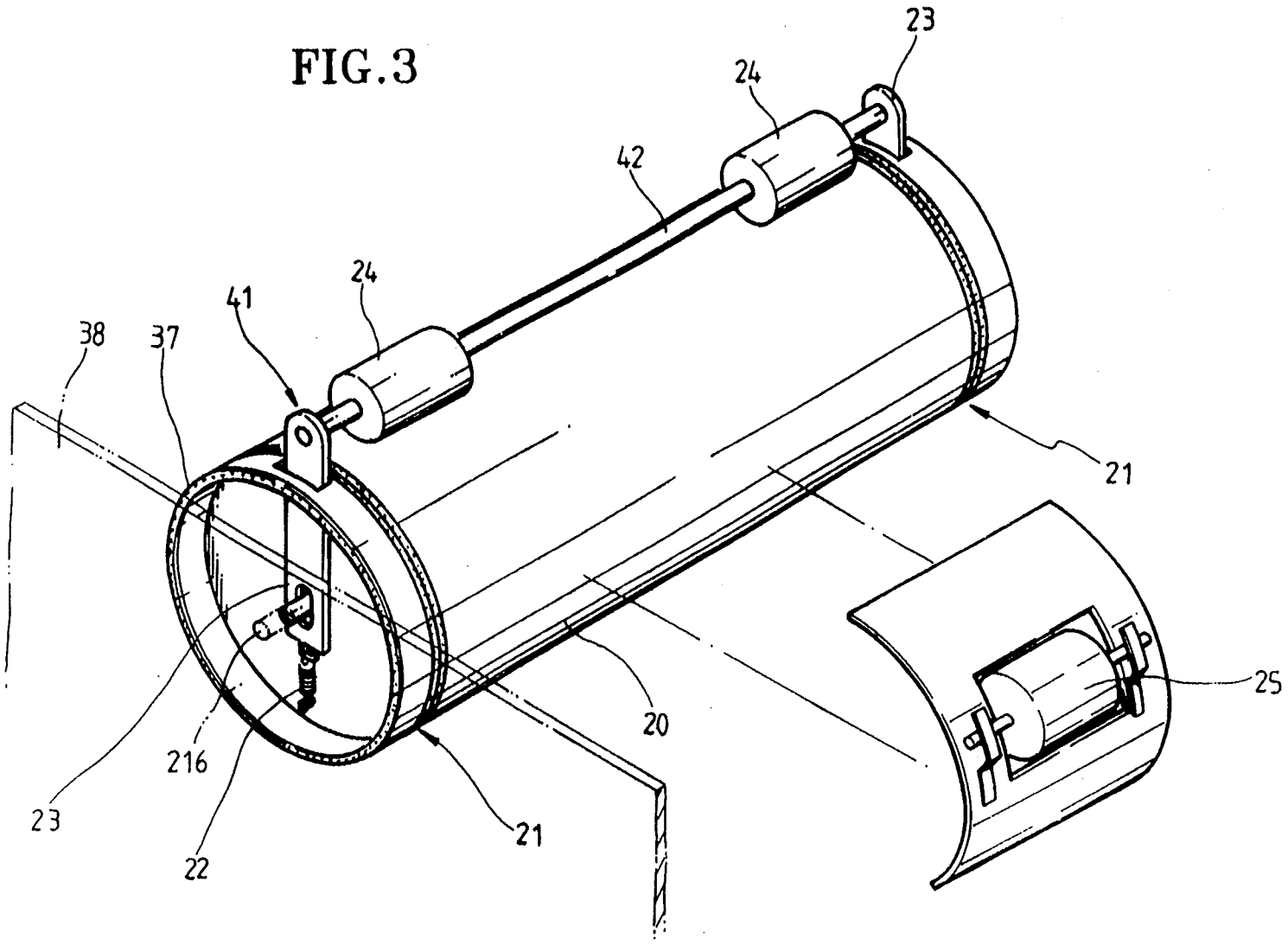
FIG. 3 is a perspective view of a borderless printer having a clamp according to the present invention.

Referring to FIG. 3, a drum 20 is rotatably supported on a base frame 38 by a rotary drum shaft 216 connected to a motor (not shown). A clamp assembly 41, provided from one end of drum shaft 216 to the other end thereof and extending along the outer length of the drum 20, has rollers 24 which are supported by clamps 23 and a clamp rod 42 so as to rotate with respect to the drum surface and come into contact with a supplied sheet of paper. A guide roller 25, which is supported by plate springs, for contacting the paper sheet on the drum is installed at the circumference of drum 20.

Figure 4A:
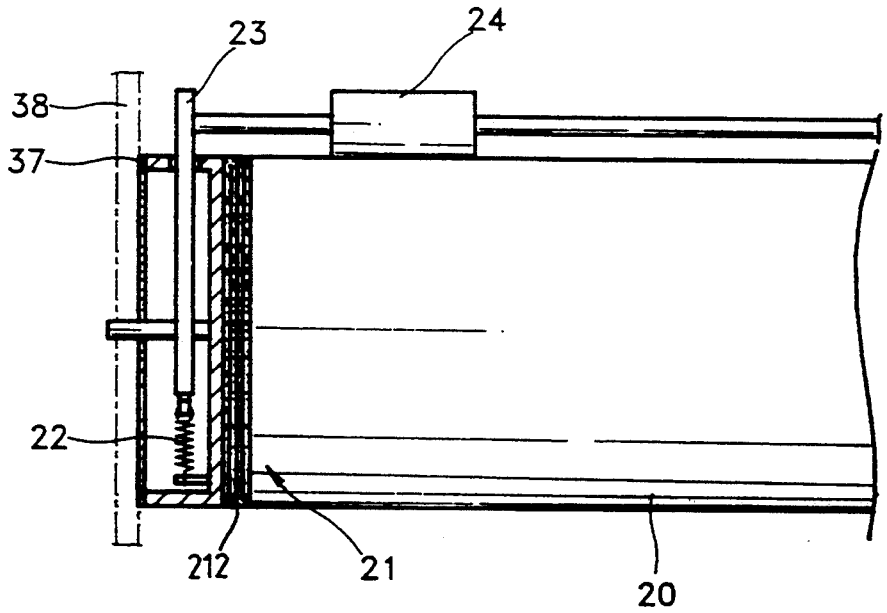
FIG. 4A is a side view showing the installation position of an electronic clutch of the borderless printer of the present invention.
Figure 4B:
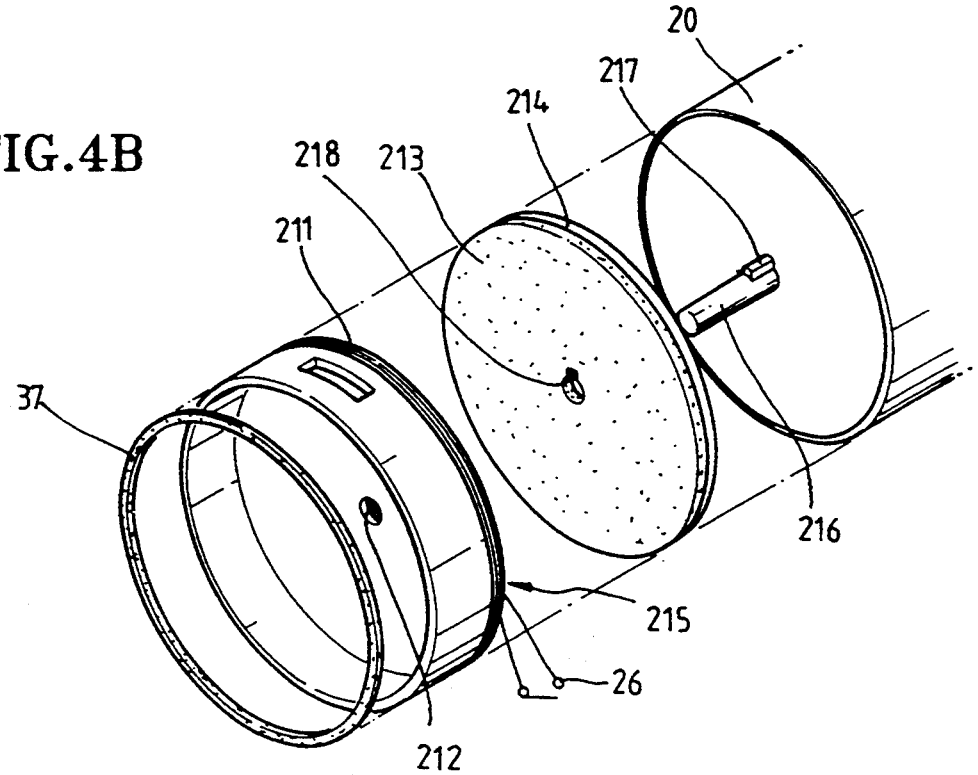
FIG. 4B is an exploded perspective view of the electronic clutch.

Referring to FIGS. 4A and 4B, electronic clutches 21 are provided on both ends of the drum. A switch 26 for supplying or blocking power to the electronic clutches is installed thereon. The clamps 23 can rotate by the rotation force of the drum or stop by the friction of the clutches according to the operation of electronic clutches 21 provided on the ends of the drum 20.

A spring 22 elastically biased for pressing roller 24 of the clamp 23 onto the drum 20 is placed between the drum 20 and the clamp 23 having rollers 24 which rotate while in contact with the drum 20. Friction surfaces 37 are provided for creating friction between first iron plates 215 provided at the opposite ends of the drum 20 and the base frame 38.

As shown in FIGS. 4A and 4B, electronic clutches 21 each comprise, along drum shaft 216, a first iron plate 215 which is placed on the ends of drum 20 and rotates along with clamp 23, and can act as an electromagnet, a coil 211 wound on first iron plate 215 for creating a magnetic force therewith, a switch 26 for turning on/-off power to the coil, a first friction sheet 212 adhered to first iron plate 215 for creating friction, a second iron plate 214 installed on drum 20 for supplying the rotation force and influenced by the magnetic force of the first iron plate 215, a second friction sheet 213 installed on the second iron plate 214 for creating friction with the first friction sheet 212 adhered on the first iron plate 215, and a key 217 for preventing the rotation of the second iron plate 214 and the second friction sheet 213 with respect to the drum shaft 216 by being inserted into a keyway 218 commonly provided in each.

When switch 26 is turned on, current flows through coil 211 of electronic clutch 21 and thus the first iron plate 215 becomes an electromagnet. Then, the first iron plate 215 attracts the second iron plate 214 placed in the vicinity thereof so that the second .iron plate 214 is held fast to first iron plate 215 by electromagnetism. Here, the second friction sheet 214 rotates along with drum 20 by key 217. Accordingly, the clamp 23 with the first iron plate 215 and the drum 20 with the second iron plate 214 rotate together by the first and second friction sheets 212 and 213 placed between the second iron plate 214 and the first iron plate 215.

When the switch 26 is turned off, current does not flow through the coil 211 of electronic clutch 21. Thus, the first iron plate 215 does not become an electromagnet, and the clamp 23 does not rotate due to the friction between the friction surface 37 at the end of each of the iron plates 215 and the base frame 38, rather than the friction between the first and second friction sheets 212 and 213.

From now on, the operation of the borderless printer of the present invention will be explained with reference to FIGS. 5A–5F.

Figure 5A:
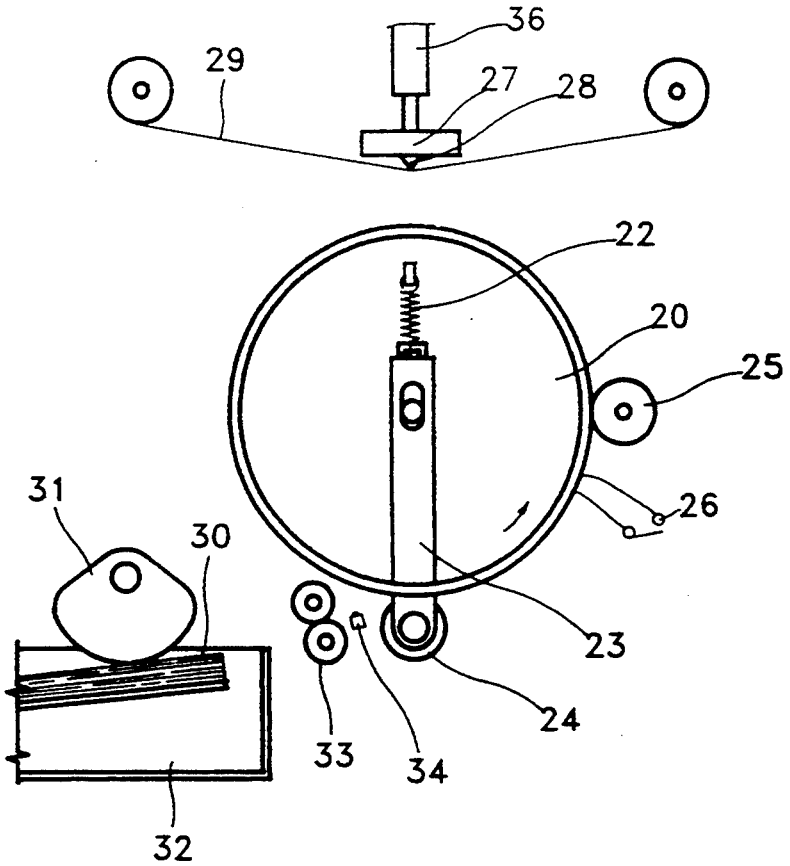
FIGS. 5A–5F are side views to illustrate the operation of the borderless printer of the present invention.

Referring to FIG. 5A, the thermal transfer printer of the present invention comprises a thermal transfer head 27 for transferring image data by means of heat, ink film 29 for providing ink to the paper sheet, a heating element 28 attached to the bottom of the thermal transfer head 27 for transferring heat onto ink film 29, a controller 36 placed above the thermal transfer head 27 for raising and lowering the thermal transfer head 27 and pressing a sheet of paper 30 and the ink film, the guide roller 25 installed at the circumference of the drum for forcing the paper sheet into contact with the drum, a sensor 34 for detecting the presence of a sheet of paper, a paper feeding cam 31 for supplying the paper sheet, a paper feeding cassette 32, and paper feeding rollers 33.

FIG. 5A shows an initial state for printing an image on a sheet of paper. Referring to FIG. 5A, roller 24 of the clamp 23 is situated at the bottom point of drum 20. In other words, switch 26 of the electronic clutch 21 is switched off so that clamp 23 does not revolve along with the drum due to the friction between the base frame 38 and friction surface 37 so as to hold the first iron plate 215 (refer to FIGS. 4A and 4B).

When paper sheet 30 contained in paper feeding cassette 32 is fed to paper feeding roller 33 by paper feeding cam 31, sensor 34 detects the leading edge of the paper sheet. Subsequently, the paper sheet is fed between the drum 20 and the roller 24. Here, as roller 24 rotates in accordance with the rotation of the drum, the paper sheet 30 is inserted smoothly with the guide of roller 24 and comes into contact with drum 20 by roller 24 receiving force from spring 22.

Figure 5B:
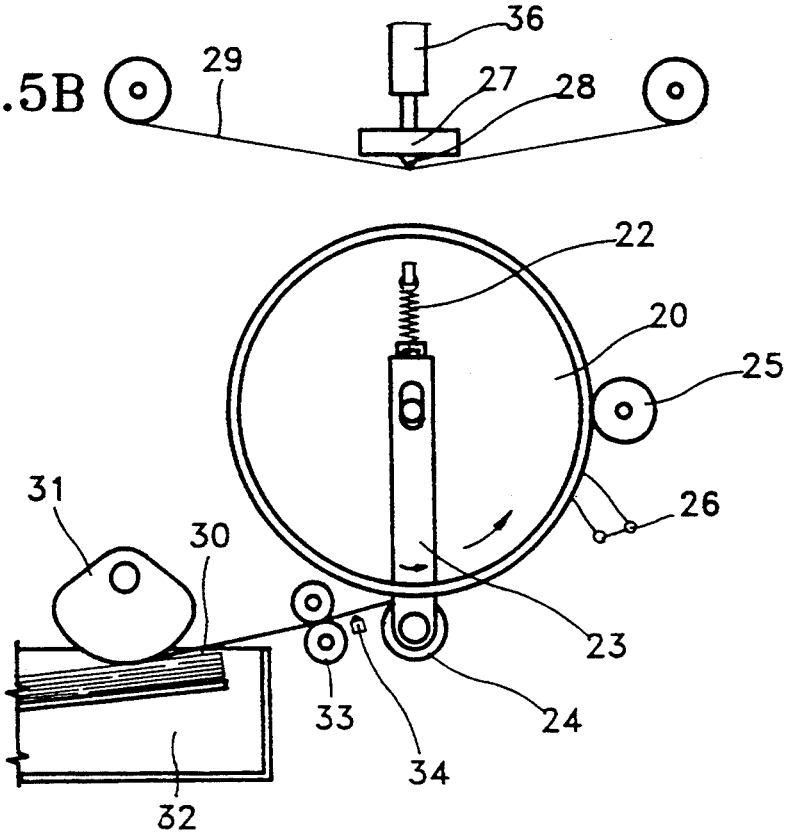
Figure 5C:
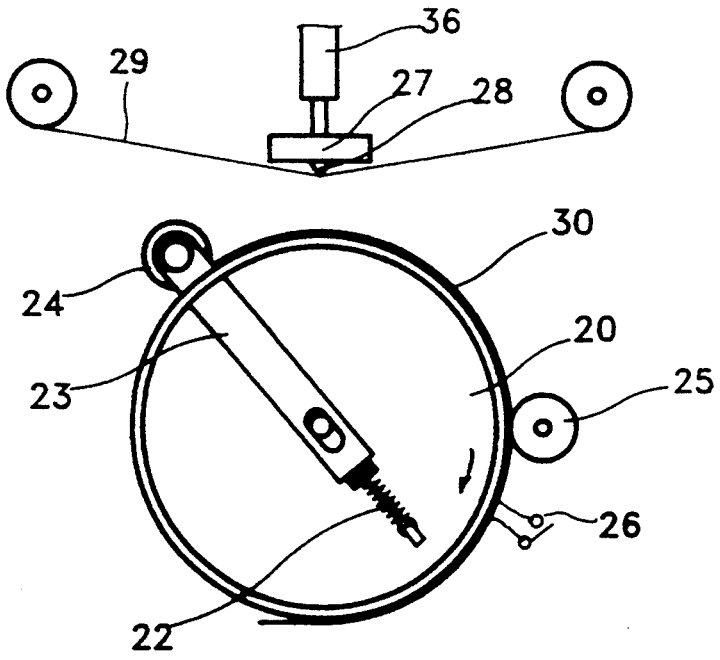

When a predetermined time elapses, after the detection of the leading edge of paper sheet 30 by sensor 34, the leading edge of the paper sheet is fully inserted between roller 24 and drum 20, as shown in FIG. 5B. In this state, when switch 26 of the electronic clutch 21 is closed, the clamp 23 forces the paper sheet into contact with drum 20, rotates according to the rotation of drum 20 such that the clamp rod 42 of the clamp assembly 41 passes between the drum 20 and the guide roller 25 by pushing the plate spring supported guide roller 25, and stops beyond printing head 27, as shown in FIG. 5C. Here, the latter portion of the paper sheet is held in contact with drum 20 by the guide roller 25.

In FIG. 5C, the clamp 23 forces the paper sheet 30 into contact with drum 20 and stops beyond printing head 27. Subsequently, the switch 26 of the electronic clutch 21 is switched off. Here, printing head 27 receives a first downward force from controller 36 and presses the paper sheet 30 onto the drum 20. In this state, the drum 20 rotates reversely (i.e., clockwise in FIG. 5C) and moves the paper sheet back to an initial printing position 35 according to the signal detected by sensor 34.

Figure 5D:
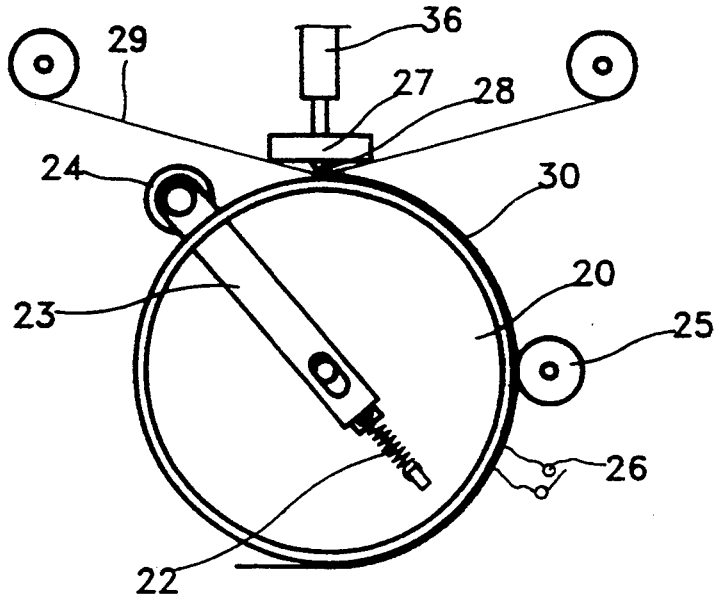

In FIG. 5D, when the paper sheet 30 reaches the initial printing position 35, the drum rotates forwardly. Here, the printing head 27 receives a second downward force from controller 36 and presses the paper sheet so that printing starts from the leading edge of paper sheet 30.

Figure 5E:
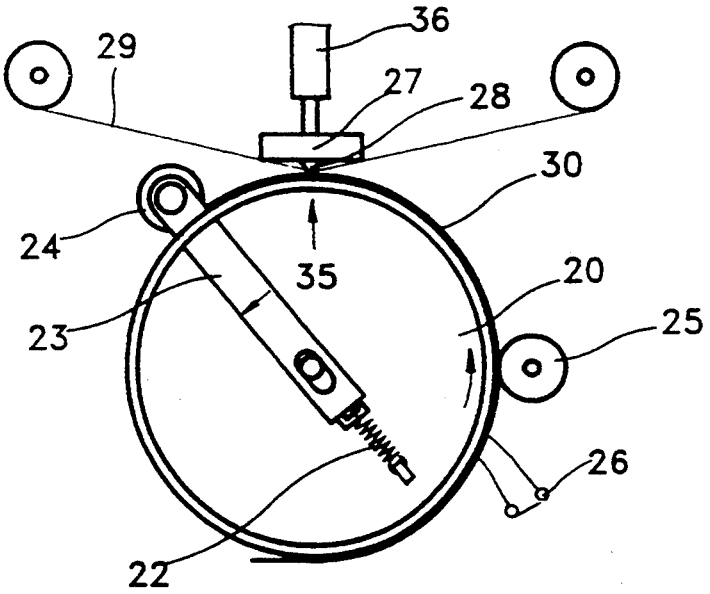
Figure 5F:
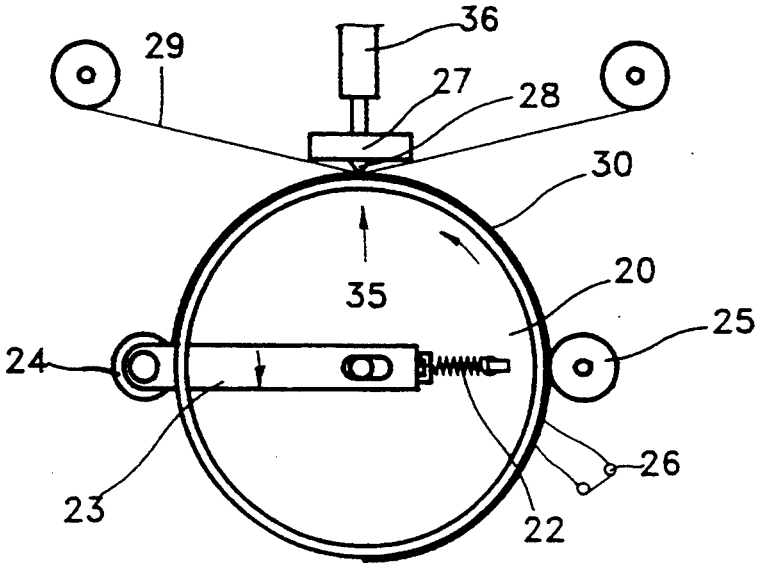

When the printed leading edge of paper sheet 30 reaches roller 24 of clamp 23 and is in contact with the drum by the roller as shown in FIG. 5E, switch 26 of electronic clutch 21 is closed so that the clamp 23, which holds the paper sheet in contact with the drum, rotates along with drum 20 and therefore the paper sheet is guided while in contact with drum (see FIG. 5F). All three colors are printed by the same procedure, and a full color image is accomplished by repeating the above process for each remaining color.

As described above, the printer of the present invention leaves no margins on a sheet of paper and prevents an image from being printed in a skewed state, which reduces wasted paper. This is accomplished without any contraction or truncation of the image to be printed, so that the printed image has a photograph-like appearance. Further, the printer simplifies and accurately performs the operation of a clamp, thereby reducing production cost while enhancing printing quality.

It is contemplated that numerous modifications may be made to the borderless printer of the present invention without departing from the spirit and scope of the invention as defined in the following claims.

What is claimed is:

1. A borderless printer comprising a rotating drum for conveying a paper sheet, a clamp assembly rotatable with the drum for forcing the paper sheet into contact with the drum, and a printing head for printing an image on the paper sheet, said clamp assembly comprising:

a clamp;

at least one roller installed on said clamp and located at a circumferential surface of said drum and operative to rotate while in contact with said drum; and an electromagnetic clutch including a friction member placed between said clamp and said drum and operative between one position wherein said clamp is constrained to rotate together with said drum and another position wherein said drum rotates relative to said clamp.

2. The borderless printer as claimed in claim 1, wherein said electromagnetic clutch comprises:

said friction member which includes a first iron plate for supporting said clamp and serving as an electromagnet;

a coil wound around said first iron plate for generating a magnetic force to said first iron plate;

a switch for supplying power to said coil;

a first friction sheet attached to said first iron plate, for generating friction;

a second iron plate placed on an end of said drum and influenced by the magnetic force; and a second friction sheet placed on said second iron plate, for generating friction with said first friction sheet.

3. The borderless printer as claimed in claim 1, wherein said clamp assembly further comprises a clamp rod supported by said clamp and rotatably supporting said at least one roller.

4. A borderless printer comprising a rotating drum for conveying a paper sheet, a clamp assembly rotatable with the drum for forcing the paper sheet into contact with the drum, and a printing head for printing an image on the paper sheet, said clamp assembly comprising:

a clamp;

at least one roller installed on said clamp and located at a circumferential surface of said drum and operative to rotate while in contact with said drum; and clutch means, placed between said clamp and said drum, for permitting said drum to rotate relative to said clamp in one condition and for permitting said drum and said clamp to rotate together in another condition, wherein said clutch means comprises:

a first iron plate for supporting said clamp and serving as an electromagnet;

a coil wound around said first iron plate for generating a magnetic force to said first iron plate;

a switch for supplying power to said coil;

a first friction sheet attached to said first iron plate, for generating friction;

a second iron plate placed on an end of said drum and influenced by the magnetic force; and a second friction sheet placed on said second iron plate, for generating friction with said first friction sheet.

* * * * *